US006177194B1

(12) United States Patent
Koppe

(10) Patent No.: US 6,177,194 B1
(45) Date of Patent: Jan. 23, 2001

(54) CELLULOSE ACETATE FILAMENTS WITH A TRILOBAL CROSS SECTION

(75) Inventor: Wolfgang Koppe, Freiburg (DE)

(73) Assignee: Rhodia Acetow GmbH, Freiburg (DE)

( * ) Notice: Under 35 U.S.C. 154(b), the term of this patent shall be extended for 0 days.

(21) Appl. No.: 09/446,465

(22) PCT Filed: Jul. 15, 1998

(86) PCT No.: PCT/EP98/04409

§ 371 Date: Jan. 14, 2000

§ 102(e) Date: Jan. 14, 2000

(87) PCT Pub. No.: WO99/04071

PCT Pub. Date: Jan. 28, 1999

(30) Foreign Application Priority Data

Jul. 16, 1997 (DE) ..... 197 30 485

(51) Int. Cl.[7] ..... D01F 2/00; D01F 2/24; D01F 2/28

(52) U.S. Cl. ..... 428/393; 428/397

(58) Field of Search ..... 428/364, 393, 428/397; 536/56, 58

(56) References Cited

U.S. PATENT DOCUMENTS

| | | |
|---|---|---|
| 2,829,027 | 4/1958 | Raynolds et al. . |
| 3,543,769 | 12/1970 | Arthur . |

FOREIGN PATENT DOCUMENTS

| | | |
|---|---|---|
| 43 02 055 C1 | 1/1993 | (DE) . |
| 1 660 621 | 3/1994 | (DE) . |
| 0 608 744 A1 | 1/1994 | (EP) . |
| 0 711 512 A2 | 5/1996 | (EP) . |
| 884 203 | 12/1961 | (GB) . |
| 2 152 871 | 8/1985 | (GB) . |
| 63-270806 | 11/1988 | (JP) . |
| 4-065540 | 3/1992 | (JP) . |
| 10-168650 | 6/1998 | (JP) . |

*Primary Examiner*—Newton Edwards
(74) *Attorney, Agent, or Firm*—Darby & Darby

(57) ABSTRACT

The invention is directed to a cellulose acetate filaments.

5 Claims, No Drawings

CELLULOSE ACETATE FILAMENTS WITH A TRILOBAL CROSS SECTION

The invention relates to cellulose acetate filaments with a trilobal cross-sectional shape and a degree of substitution of about 2.1 to 3.0.

Cellulose acetate filaments, which are used for the production of filter tow, should have as large a specific surface area as possible, that is, as large a specific surface area per unit weight of filter tow as possible, in order to present a large, active surface area for the pollutants in cigarette smoke. By these means, a high filtration capacity and, at the same time, an economical use of raw materials become possible. Important parameters for determining the specific surface area are the filament titer, which give the mass of the filament per unit length, and the form factors PE and KH, each of which represents a measure of the ratio of the cross sectional area to the square of the circumference or to the area of the convex shell. If a large specific surface area is to be formed, these parameters must be kept as small as possible.

The trilobal cross sections represent a cross sectional shape, advantageous for achieving low form factors and, with that, a high specific surface area. Filaments of trilobal cross sectional shape are known from the state of the art and are spun from orifices, which have a triangular cross-sectional surface. Such a manufacturing process is disclosed, for example, in the DE 43 02 055. The trilobal, that is, three-armed, star-shaped conformation of the cellulose acetate filaments is formed during this process by the evaporation of the solvent, in general, acetone, after the extrusion. The values for the form factors, achievable with these orifices of the state of the art, are about 0.360 to 0.400 for the PE form factor and 0.580 to 0.620 for the KH form factor.

Alternatively, it is possible to achieve the desired large surface area by a bundle of extremely fine filaments of circular cross section. These thin filaments are spun from small round-hole orifices. A corresponding method is disclosed in U.S. Pat. No. 5,269,996. However, the process of extruding from these very fine round-hole orifices, which have a diameter smaller than 36 $\mu$m, is extremely difficult. Accordingly, appreciable problems arise during the technical realization of this method.

A further method for the production of cellulose acetate fibers for the cigarette industry is disclosed in U.S. Pat. No, 5,512,230. In the method, described in this patent, the addition of 5% to 40% of water to the spinning solution enables cellulose acetate fibers, with a degree of substitution of 1.0 to 2.2, to be extruded.

It has now turned out that, from the point of view of the desirable properties, the filament titers, produced above, require improvement in the filter materials, especially in filters of cigarettes, particularly with respect to the filtration of smoke components. Proposals are known for achieving these improvements by chemical means. Significant advice for the further development of the state of the art, described above, by undertaking physical modifications, is not found in the literature.

Admittedly, the EP 0 711 512 discloses fibrillated cellulose ester fibers with a small average diameter and a large specific surface area. However, this publication does not contain any reference to a trilobal cross-sectional shape of these fibers. Rather, their morphology is practically of undefined form, that is, branched up to a high degree of order. For the production of such fibrillated, that is, split fibers, a cellulose ester solution is extruded from an orifice and passed into a precipitating medium for the cellulose ester, shear forces acting on the extrudate. Only the fibers, fibrillated in this manner, have a high specific surface area. The geometric cross section of the fibers is only of slight importance for the coming about of this specific surface area. The fiber length of the cellulose esters, known from this publication, generally is about 0.1 to 10 mm and preferably about 0.2 to 5 mm. Accordingly, endless filaments are not produced. As a method for measuring the specific surface area of these fibrillate fibers, the BET method was employed, which is based on the principle that the surface of a solid absorbs a certain amount of gas molecules. The additional surface area, formed by the finest branchings of the fibrillation, can be measured exactly with this method.

Accordingly, it was an object of the invention to propose cellulose acetate filaments with a trilobal cross section, which improve the state of the art described above with respect to the efficiency during the absorption of smoke components in filters of cigarettes. It shall be possible to accomplish the production of these fibers simply and with conventional techniques.

Pursuant to the invention, the objective described above is accomplished by cellulose acetate filaments with a degree of substitution of about 2.1 to 3.0 and a trilobal cross-sectional shape, which have a filament titer of less than 3.3 dtex, a PE form factor of less than 0.320 and a KH form factor of less than 0.560.

It is evident that values lower than 3.3 dtex, together with the advantageous form factors, lead to special advantages, namely to an improved absorption and adsorption behavior when these fibers are used in filters of cigarettes. In other words, this means that a larger surface area is achieved while the mass of filaments remains constant. In distinction from the cellulose ester fibers described in the EP 0 711 512, this increase in the specific surface area is achieved by optimizing the geometric cross section of cellulose acetate filaments. The inventive filaments are not fibrillated or split. A lower boundary value for the titer cannot be stated precisely. However, from practical points of view of the manufacturer, it can be assumed that manufacturing difficulties would be encountered at a titer below about 0.7 dtex. In this connection, it is necessary to focus on the difference that the lowest filament titers can also be obtained with orifices with round holes. This is not equally required for filaments with a trilobal cross section, within the scope of the present invention. A range of about 0.7 to 2.7 dtex and especially of 1.0 to 2.5 dtex is also to be regarded as particularly advantageous.

Within the scope of the invention, the PE form factor is less than 0.320. With respect to practical considerations during the manufacture, a minimum value of about 0.18 could also be assumed to be the lower value, the range from 0.2 to 0.3 being preferred.

Considerations, similar to those for the PE form factor, also apply for the KH form factor in regard to the preferred boundary conditions. A value of about 0.35 can be stated to be the preferred lower value, the range of about 0.4 to 0.52 being regarded as particularly preferred.

The filaments described are obtained by extrusion from orifices with a trilobal cross-sectional shape. The cross-sectional area of the inventive orifices is about 0.002 $mm^2$ for a PE form factor of the capillary cross section of the orifice of about 0.37. The trilobal cross-sectional shape of the cellulose acetate filaments is thus specified already by the cross section of the orifices. As a result, filaments can be attained with form factors, which are significantly more advantageous than those of the state of the art.

The ratio of the surface area to the mass of the filament can be improved appreciably by the inventive decrease in the form factor. For example, filaments with a titer of 3 dtex and a PE form factor of 0.380 have a specific surface area of 0.290 $m^2/g$. By reducing the PE form factor to 0.300, a specific surface area of 0.327 $m^2/g$ is obtained for filaments of the same degree of fineness. This corresponds to an increase in the surface area of 13% for the same mass of filaments. It should be noted that the above values for the specific surface areas were determined by geometric calculations alone and thus, in any case, are below those values, which would be obtained by measurements with the BET method. Accordingly, the inventive filaments can be realized with economic use of raw materials and thus also with decreased costs.

The extrusion process can also be accomplished in the conventional manner by dry spinning. Accordingly, the inventive cellulose acetate filaments are distinguished by a high smoke absorption capacity as well as by the ease of manufacture. Since the degree of substitution DS of the cellulose acetate is about 2.1 to 3.0, especially about 2.3 to 2.9 and particularly 2.3 to 2.7, it is possible to work with a conventional spinning solution with a water content of about 3%. A degree of substitution of about 2.5 is regarded as particularly preferred.

The invention shall now be explained by means of examples. In each case, a cellulose acetate spinning solution in acetone was used for the examples described.

EXAMPLE 1

| | |
|---|---|
| Spinning solution: | |
| Degree of substitution of the cellulose acetate (DS): | 2.48 |
| Concentration of the cellulose acetate: | 27.8% |
| Water concentration: | 3.5% |
| Viscosity of the spinning solution: | 68 Pa × s |
| Spinning Conditions: | |
| Temperature of the spinning head: | 56° C. |
| Temperature in the spinning cell: | 65° C. |
| Trilobal extrusion die with 125 boreholes | |
| Spinning speed: | 300 m/min |
| Drawing factor: | 1.6 |

By means of the spinning method, carried out with the parameters given, filaments are obtained with a titer of 3.0 dtex per filament, a PE form factor of 0.290 as well as a KH form factor of 0.505 and, with that, an advantageously large surface area. With that, the filaments show better filtration properties for smoke components of cigarettes.

EXAMPLE 2

| | |
|---|---|
| Spinning solution: | |
| Degree of substitution of the cellulose acetate: | 2.45 |
| Concentration of the cellulose acetate: | 28.5% |
| Water concentration: | 2.7% |
| Viscosity of the spinning solution: | 71 Pa × s |
| Spinning Conditions: | |
| Spinning temperature: | 56° C. |
| Temperature in the spinning cell: | 65° C. |
| Trilobal extrusion die | |
| Cross-sectional area of orifice: | 0.00118 $mm^2$ |
| Spinning speed: | 400 m/min |
| Drawing factor: | 2.1 |

With the parameters given, cellulose acetate filaments with a degree of fineness of 2.1 dtex, a PE form factor of 0.303 as well as a KH form factor of 0.517 are attained. The advantages here are the same as those in the first example.

What is claimed is:

1. Cellulose acetate filaments with a trilobal cross section and a degree of substitution of about 2.1 to 3.0, wherein the filaments have a titer of less than 3.3 dtex, a PE form factor of less than 0.320 as well as a KH form factor of less than 0.560, the form factors being defined by the following ratios:

$$PE=4\pi A/P^2 \text{ and } KH=A/A_k,$$

wherein A=cross-sectional area of the filament, P=circumference of the filament cross section and $A_k$=area of the convex shell of the filament cross section.

2. The cellulose acetate filaments of claim 1, wherein said filaments have a degree of substitution of about 2.2 to 2.7.

3. The cellulose acetate filaments of claim 1, wherein said filaments have a filament titer of about 0.7 to 2.7 dtex.

4. The cellulose acetate filaments of claim 1, wherein said filaments have a PE form factor of about 0.2 to 0.3.

5. The cellulose acetate filaments of claim 1, wherein said filaments have a KH form factor of about 0.4 to 0.52.

* * * * *